US006412194B1

(12) United States Patent
Carlson et al.

(10) Patent No.: US 6,412,194 B1
(45) Date of Patent: Jul. 2, 2002

(54) WAX FILLED PADS

(75) Inventors: J. Martin Carlson, Mora; Stacey R. Stoll, Columbia Heights, both of MN (US)

(73) Assignee: Tamarack Habilitation Technologies, Inc., Blaine, MN (US)

( * ) Notice: Subject to any disclaimer, the term of this patent is extended or adjusted under 35 U.S.C. 154(b) by 0 days.

(21) Appl. No.: 09/433,997

(22) Filed: Nov. 4, 1999

(51) Int. Cl.[7] ..... A61F 5/14; A43B 7/14
(52) U.S. Cl. ..... 36/43; 36/71; 36/88; 36/154
(58) Field of Search ..... 36/71, 43, 153, 36/154, 88, 93

(56) References Cited

U.S. PATENT DOCUMENTS

| | | | | |
|---|---|---|---|---|
| 2,645,865 A | * | 7/1953 | Town | 36/71 |
| 3,615,972 A | | 10/1971 | Morehouse, Jr. et al. | 156/79 |
| 3,736,673 A | | 6/1973 | Dubner | 36/44 |
| 3,765,422 A | * | 10/1973 | Smith | 36/29 |
| 3,871,117 A | | 3/1975 | Richmond et al. | 36/43 |
| 4,083,127 A | | 4/1978 | Hanson | 36/93 |
| 4,123,855 A | * | 11/1978 | Thedford | 36/44 |
| 4,211,019 A | | 7/1980 | McCafferty | 36/43 |
| 4,255,202 A | | 3/1981 | Swan, Jr. | 106/122 |
| 4,464,850 A | | 8/1984 | Ebert et al. | 36/44 |
| 4,471,538 A | | 9/1984 | Pomeranz et al. | 36/28 |
| 4,510,699 A | | 4/1985 | Nakamura et al. | 36/43 |
| 4,567,677 A | | 2/1986 | Zona | 36/43 |
| 4,603,493 A | | 8/1986 | Eston | 36/44 |
| 4,685,224 A | | 8/1987 | Anger | 36/43 |
| 4,768,295 A | | 9/1988 | Ito | 36/28 |
| 4,843,735 A | | 7/1989 | Nakanishi | 36/28 |
| 4,934,071 A | | 6/1990 | Virgini | 36/29 |
| 5,005,575 A | | 4/1991 | Geri | 128/581 |
| 5,058,291 A | | 10/1991 | Hanson | 36/117 |
| 5,067,255 A | | 11/1991 | Hutcheson | 36/43 |
| 5,149,588 A | | 9/1992 | Fukushima et al. | 428/411.1 |
| 5,154,682 A | * | 10/1992 | Kellerman | 36/44 |
| 5,167,999 A | | 12/1992 | Wang | 428/178 |
| 5,313,717 A | * | 5/1994 | Allen et al. | 36/153 |
| 5,362,543 A | * | 11/1994 | Nickerson | 428/76 |
| 5,392,533 A | | 2/1995 | Gerhartl | 36/43 |
| 5,418,037 A | | 5/1995 | Maeder et al. | 428/137 |
| 5,686,167 A | * | 11/1997 | Rudy | 36/29 |
| 5,778,561 A | | 7/1998 | Shimoyama | 36/43 |
| 5,869,164 A | * | 2/1999 | Nickerson et al. | 428/76 |
| 5,878,510 A | * | 3/1999 | Schoesler | 36/43 |
| 5,933,984 A | * | 8/1999 | Carlson et al. | 36/43 |

FOREIGN PATENT DOCUMENTS

| | | |
|---|---|---|
| DE | 198 01 301 | 11/1998 |
| EP | 0 714 613 | 6/1996 |

* cited by examiner

*Primary Examiner*—M. D. Patterson
(74) *Attorney, Agent, or Firm*—Westman, Champlin & Kelly, P.A.

(57) ABSTRACT

A pad for supporting a portion of the human body is made of two substantially non-stretchable or non-elastic layers that are joined together along a peripheral edge and then are joined together in local regions to form individual capsules in the pad. The layers are "quilted" in the areas defined by the capsules to control where and how much the pad can bulge. The pad is filled with a wax material that is plastic but does not flow readily. By repeated applications of loads the wax will flow or migrate slowly to change the configuration of the wax to conform to and support the surface contacting the pad.

18 Claims, 10 Drawing Sheets

WAX FILLED PADS

BACKGROUND OF THE INVENTION

The present invention relates to a pad construction that is used for padding the human body, such as an insole pad, filled with a material, preferably a wax for conforming slowly to the foot or other body part of a user. The filling is in an envelope which has design features which limit bulging and prevent most peristaltically induced migration of the wax filling. The wax filling moves slowly under weight-bearing forces to form into rather firm concave support surfaces under bony prominences of weight-support areas of the body such as the plantar surfaces of the feet.

In the prior art, a wide range of different types of padded insoles have been used, and the use of various fillings has also been discussed. Insoles have been used which are essentially bladders, having upper and lower layers that are sealed along their edges, and these have been filled with materials such as water, air, and even some that have gum-like elasticity at normal in-door temperatures.

Many of these pads show compartments formed between the layers, so that the materials will flow between compartments as loads change.

It has been observed that old well-worn shoes are preferred by many, in particular Geriatric patients because compaction and wear under the high pressure, bony areas of the foot cause an old shoe to "wear in" to a comfortable support contour. However, old shoes do eventually become unserviceable and must be replaced with new ones. There are physiologic reasons why people need better-fitting shoes as they age. Aging muscles will atrophy, and there is a loss of bone mass. These physical changes rob the body of some of its ability to control and absorb shock by deceleration before impact (heel strike) during gait, and such physical changes can often develop into osteoporosis. Loss of flexibility of the joints also affects the body's ability to adapt to changes in gait cycles or plantar loading. Add the loss of plantar fat pads (located under bony, load bearing prominences of the foot to act as biological shock absorbers), as part of the natural aging process, and the body loses yet another of its defenses against excessive loading on the plantar surface of the foot. All of these changes, combined with a refusal to slow down and accept the coming of age by appropriately adapting lifestyles, can lead to fatigue damage (e.g. strains, bruises, tears of tendons and ligaments, stress fractures, and even the development of worsening of an arthritic condition).

People with one or more of the foot problems just described will find it difficult to tolerate new pairs of prior art shoes, claiming the new shoes are not as comfortable as the old shoes. New shoes typically are uncomfortable for these people until many months of wear have generated concave support contours under bony prominences of the foot. Thus, there is a need for an insole that will provide the custom contoured footbed of the old shoes, after a minimal number of gait cycles, while being worn in the new shoe. By providing this quick footbed break-in for the shoe, comfort can be had with new shoes that provide good support from the last, good ground contact with the new outsole, with the contoured footbed surface from the insole molded or formed to fit the dynamic contours of the owners' feet.

SUMMARY OF THE INVENTION

The present invention relates to a pad for supporting a portion of a human body. The pad has an envelope formed by two overlying layers of strong, high tensile elastic modulus material. The layers of material are sealed along the edges to form a sealed interior compartment. To control peristaltically induced migration of filling material, the pads are preferably further joined at spaced locations, or compartmentalized to form sealed capsules by seams joining the layers within the perimeter of the pad. To control the degree/thickness of bulging within each of the inner sealed capsules, the envelope material layers may be joined in various configurations within the perimeter of those envelopes. The layers forming the envelope can be quilted, or joined in spots or with short pier like seams or darts, which means small area portions of the layers are fused or adhered together in a particular selected pattern to control envelope volume and limit movement of the filling material into the bulged areas as wax is squeezed out of the higher pressure areas under bony prominences. Uncontrolled bulging would allow the concave support surface to have an excessively large, central area where all the filler is pushed out. Such a contour would not spread support loadings as well. Also, it is important to limit envelope thickness for reasons of comfort.

The layers forming the pad envelope should be of a material with a tensile modulus high enough so they stretch very little under the loads imposed by this application. This is necessary so that control of the bulging, thickness and material flow is possible. Any bulging should not be the result of substantial stretching of the pad envelope material.

The filling material is preferably a wax material that does not flow immediately upon first loading, but will shift slowly under repeated applications of weight in a particular area. The slow movement or migration of the wax occurs particularly when the wax is near the temperature of human bodies and under repeated dynamic loads typical during gait. More rapid conforming can be achieved if the wax is preheated. The wax is chosen so that it will be plastic and will flow gradually with many load repetitions but yet be hard or firm and shape retaining when it reaches a location where the supported load, that is, the pressure on an area of the wax, is fairly uniform, and the pad envelope construction is preventing further shifting. The wax, while plastic, does not quickly flow under changes of pressure.

The pad compartments or capsules are chosen to keep the filling in particular areas of the pad and contain and control excessive peristaltic movement of the filling. The slow plastic flow or movement can be controlled by the "quilting" or short "pier" seams that are disclosed. Barrier seams are used to form capsules sized to keep the wax filling material from being excessively "pumped" by peristaltic type action under the foot as forceful contact proceeds usually posterior to anterior and lateral to medial during the typical weight bearing cycle of gait, and to maintain a local degree of filling that will conform to the supported surface. Capsule size and design is of particular importance to distribute pressures under irregular surfaces with bony prominences, such as the metatarsal phalangeal (MTP) joint region of a foot.

Further, pad regions, such as the metatarsal-phalangeal (MTP) joint area of an insole have a greater number of compartments or capsules and quilting junctions, so that a support thickness of the wax material in high pressure or bony areas is maintained.

The spacing of the quilting junctions between the top and bottom layers in particular capsules can be modified to regulate the maximum bulge thickness and volume of a compartment or capsule that is closed off by seams between the top and bottom pad layers.

The upper surface of the pad is preferably a low friction material, such as a Teflon® coated fabric in bony high pressure areas.

The filling material is selected so that the material will redistribute to form a cradle-like support surface only upon repeated applications of loads, such as when walking, to achieve a custom contour under the foot. A firm/bony convexity of the foot will cause a concavity in the filling material, such as wax, so that the foot bears weight on an increased area. However, again, the compartment or capsule has to be sized for volume control, so that there is material supporting the convexity such as a bony protuberance, by filling around it, to better spread the loads on the skin across the supported area.

The present construction deals with control of bulging of the wax material, so that the forming is such that excessive build-up of material in local areas, and an absence of material in other areas that need support is prevented. The spaced quilting or junctions within the compartments or capsules that are formed by seams serve a combination of functions. They prevent excessive amounts of filler material from being squeezed into low pressure areas from under the higher pressure bony areas. Excessive expulsion of filler material from those areas would leave excessively large "bottomed out" areas in the center of the cradles. That would reduce their load-spreading capability. Also excessively thick bulging in the lower pressure areas may be uncomfortable on even a barrier to the entry of the toes into the toe box of a shoe.

The filling material, which, again, is preferably a wax, has the potential to flow or redistribute only a little bit with each step. For example, say approximately 50 to 200 steps on an insole will cause the wax, acting like a truly plastic material to adequately redistribute from a uniform thickness to a multiplicity of little hills, hollows, ridges and valleys. As the pressure is equalized, because the filler material is constrained within the compartment or capsule, the material will cease to flow and will provide a firm cradle of broader support under bony areas.

Since the pad envelope material is not easily stretched, the volume of a bulged area of the capsule is fixed. A given capsule is likely to have one or more areas from which much of the wax has been expelled. The wax is pushed out because those areas lie under bony locations of the foot which tend to generate high dynamic pressures during gait. The wax thus pushed out of those areas migrates to the perimeter of those bony prominences causing the capsule to bulge. However, the high tensile modulus of the envelope material in combination with the envelope quilting or junctions limits such flow.

The pressure supporting the body portion on an individual compartment may be different from that provided by another compartment or capsule because the material is constrained. In other words, there is not necessarily an even pressure throughout the entire pad.

Additionally, the filling should have limited thickness, and as part of the volume control, there is a limitation of the bulges of the pad to certain regions or compartments.

While the preferred embodiment is shown as an insole, it can be used as a prosthesis pad to support bony areas of residual limbs. The bony area will move the filling material, such as wax, to spread the pressures that are encountered more evenly than foams.

DETAILED DESCRIPTION OF THE ILLUSTRATIVE EMBODIMENTS

Figure 1:
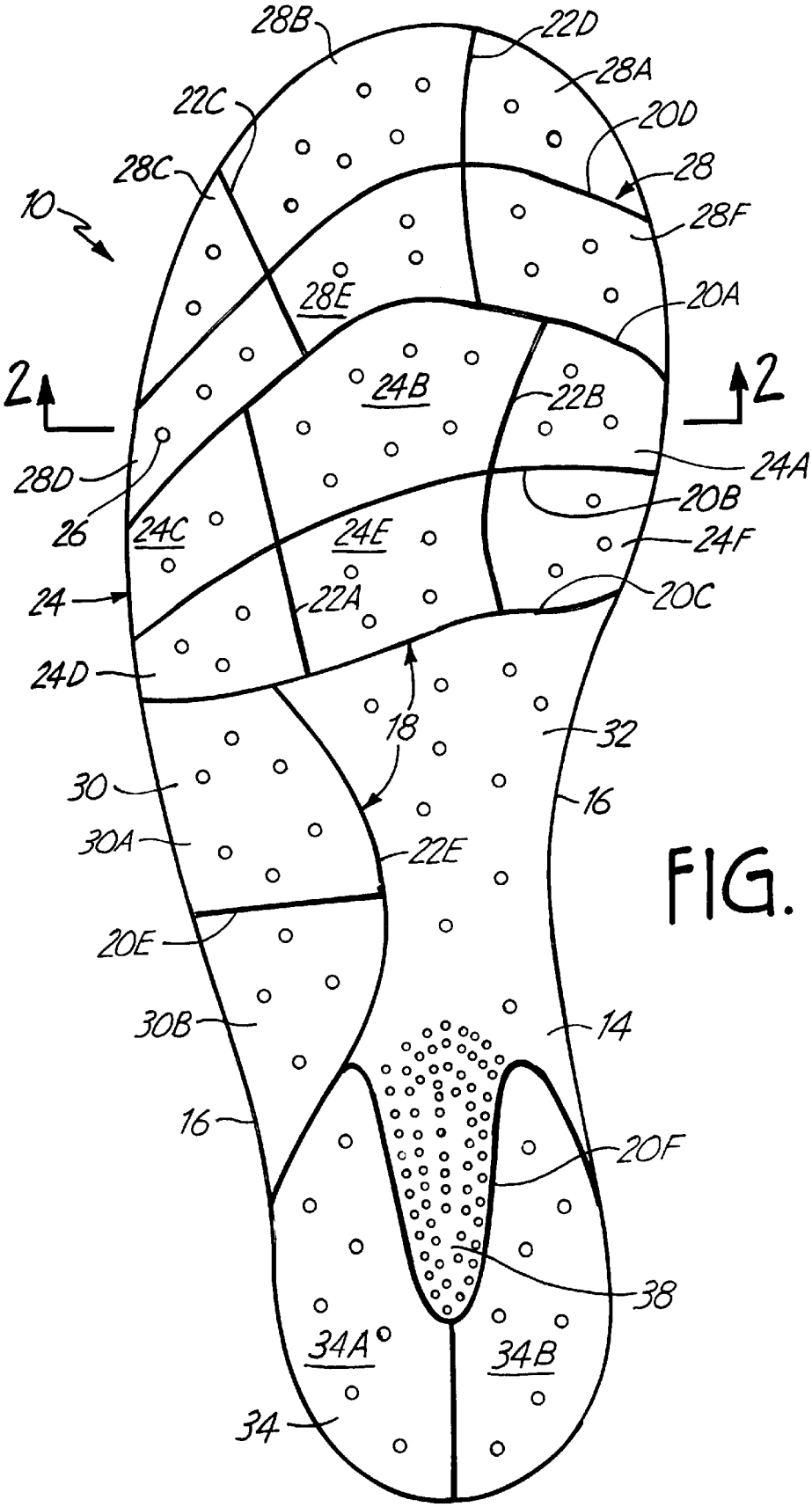
FIG. 1 is a plan view of a pad having a filling material and made according to the present invention used for an insole.

The pads of the present invention, such as that illustrated at 10 in FIG. 1, are shown as insoles, but it is to be understood they can be other types of pads that will support bony areas of a human body in particular.

Figure 2:
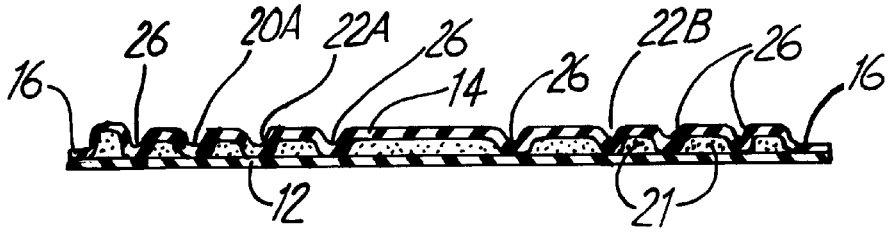
FIG. 2 is a sectional view taken as on line 2—2 in FIG. 1.

The pads have certain common characteristics, which include, as shown in FIG. 2, a base layer 12 of material, with an overlying layer 14. The common characteristics include the base layer 12 and the overlying layer 14 are made of substantially inelastic material, that is a material having a high modulus of elasticity, but also preferably material which can be heat sealed together. A tensile modulus of elasticity of greater than 25,000 psi is preferred. It also has to be thin enough to bend, flex, or fold as the filling material, preferably a wax, flows out of some regions and crowds into others. For example, the material may be a thin (under 0.010 inch thick) polypropylene or polyethylene film or a metallocene-catalyzed plastomer. Preferably, in areas where there is a combination high contact pressure and shearing motions between the foot and insole, the film will have a PTFE coating on the surface supporting the portion of the human body, such as the foot. Also, if desired a thin layer of foam can be placed over the pad to smooth out the junction between pad capsules.

The filling material is common to all of the present forms of the invention as well, and comprises a rheolically plastic material, such as a wax, in the preferred form, that is plastic under load, but is not readily flowable. In other words, by Theologically plastic, it is meant that the wax material moves or flows very slowly in response to pressures and repeated movements against its surface. In the case of an insole, the filling material will significantly redistribute itself in a range of 50–500 gait cycles, depending on its temperature, but full formation within the range of 50 to 200 gait cycles is preferred. The wax flows slowly enough at ambient temperatures and plantar pressures so that on a step-by-step basis it is presenting a firm support surface to the bottom of the foot. Another possible approach would be to pre-warm the wax to achieved "form-in" of cradling contours in fewer steps but this is time consuming and bothersome.

An ideal wax would be one that is moldable but firm throughout the range of temperatures typically encountered under foot in a shoe. The estimated temperature range within a shoe is about 70° F. to 110° F. In tests, a micro-crystalline wax (Industrial Raw Materials Corp.—Indramic 2975) with a melting temperature of 150–160° F. and needle penetration value of 35 at 77° F. and a polyethylene wax (M. Argnesco & Co.—Cerita Wax 09321) with a penetration value of 75 at 77° F. work well.

Wax is relatively incompressible compared to compressive cushioning materials such as foams, now in common use.

The relatively non-elastic or inelastic enclosure material (modulus of elasticity greater than 25,000 psi) can have more than one layer, to prevent the individual compartments from distending or bulging too far, into low pressure areas.

The volume limiting features such as a spot or line seam or "quilting" that fastens the top and bottom layers together are used to limit bulging amplitudes. The amount of filling material in a particular compartment to achieve the desired effect will not vary so much from person to person, so a standard filling can be used, and the spot and line welds help carry the loads necessary to resist outer or peripheral seam separation as well as excessive bulging.

The pads are compartmentalized or formed into capsules to resist peristaltic pumping action on the contents in the pad. Controlling the redistribution of the wax under simple repeated surface contact pressures is important. The peristaltic pumping of the wax, for example in an insole, from lateral to medial under the "ball" (MTP joint region) of the foot can be impeded and limited by dividing the area into a multiplicity of segregated capsules perpendicularly transversing the direction of the peristaltic pump action.

A measured, predetermined volume of wax is placed in each compartment or capsule. If a capsule contains too much wax, a complete cradle will not be formed under the bony areas because all areas of the capsule are at full capacity and wax migration/redistribution is thus prevented. If a capsule is filled with an inadequate volume of wax the envelope will have an excessively large cradle area under each bony prominence (see FIG. 12 for illustrations). There would be a large "bottomed out" region under bony prominences. An ideal wax volume-to-envelope volume ration would be that which just barely allows a bony prominence to "bottom out" (see FIG. 10).

Pad 10, as shown in FIGS. 1 and 2, has the base or lower layer 12 and the overlying or upper layer 14 joined along peripheral seams 16, that are of sufficient width to provide an adequate strength to resist the separation or bulging forces that occur. The peripheral seams define the size and shape of the pad. In this form of the invention, the pad is divided up into a number of different individual internal compartments or capsules that define groups of capsules. The compartments or capsules are formed generally as shown in FIG. 2, by providing intermediate seams 18, which is a general number for the intermediate seams within the periphery of the seam 16.

In this form of the invention there are transverse seams 20A, 20B, and 20C which are under the metatarsal phalangeal joint area of the foot, or the ball of the foot, and the transverse seams are joined by longitudinal seams 22A and 22B, as shown the seams make six individual compartments or capsules under the ball of the foot forming a capsule group 24. These compartments or capsules are shown at 24A, 24B, 24C, 24D, 24E and 24F.

Figure 3:
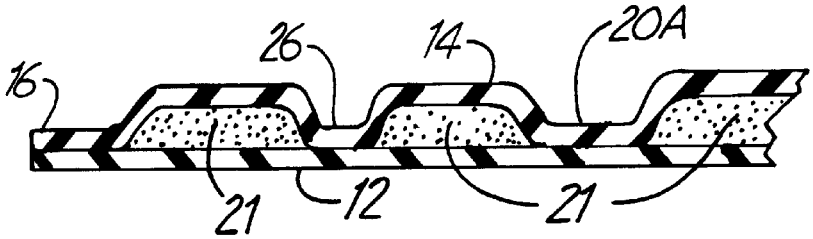
FIG. 3 is an enlarged portion of the sectional view of FIG. 2.
Figure 5:
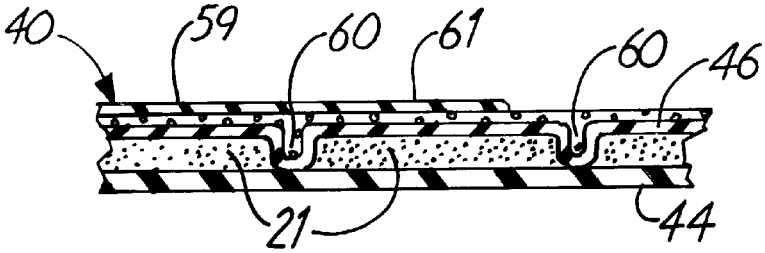
FIG. 5 is a sectional view taken as on line 5—5 in FIG. 4.

Each of the capsules 24A–24F has a filling of a material, such as a suitable wax shown at 21 in FIGS. 2, 3 and 5, that is of the selected volume to provide a layer of wax under the foot and between the foot and the shoe sole. The material is constrained in each of the individual capsules 24A–24F, and cannot flow into the other capsules in the group. In addition, for controlling the "bulging" or volume, a series of "quilting" junctions or dots 26 are provided in each of the compartments. These "quilting" junctions join the layers 12 and 14, as can be seen in FIGS. 2 and 3, and they will serve to control the movement of the wax under repeated loads.

As shown, the number of "quilting" junctions in each of the individual capsules 24A–24F can be varied to provide for adequate control. The insole shown in this figure is for the left foot, and the individual size of the capsules is made to conform to the foot. The "quilting" junctions or dots 26 are thus used for bulge control within each individual capsule or compartment defined by seams such as those shown at 20A–20C and 22A and 22B.

In the toe region of the insole, there is another capsule group 28 formed by transverse seams 20C and 20D, and longitudinal seams 22B and 22C that form six capsules or compartments 28A, 28B, 28C, 28D, 28E and 28F. The capsule group 28 underlies all of the toes. The capsules are kept small in order to retain control and keep the bulges small. Again, "quilting" junctions or dots 26 are used here to prevent excessive bulging up of the capsules of the pad, for example where there is little load. The seams 20A and 20D control movement of the filling so that the material under the metatarsal region does not merely migrate into the sulcus, which is the region between the ball of the foot and the toes or posteriorly into the arch region of the foot. Thus, control of the support provided is achieved.

Along the lateral side of the insole, there is a capsule group 30 formed by a curved longitudinal seam 22E and a transverse seam 20E. These seams form two capsules 30A and 30B. The lateral side capsules 30A and 30B have "quilting" junctions or dots 26 to control the bulging of the compartments or capsules under the lateral side of the foot.

The medial or arch side has a compartment 32 defined by seams 20C and 20F, as shown. A plurality of the "quilting" junctions 26 are in position. The loading in the instep area is less than in some of the other areas of the insole.

In FIG. 1, a heel capsule group 34 comprises two capsules 34A and 34B which are defined by the perimeter seams 16 and by seam 20F which forms a U-shaped region 38 with little or no filling of material in between the layers of the pad to accommodate the plantar ligament attachment region of the calcaneus. The region 38 is open to the insole capsule where little pressure is present. In this U-shaped region 38, there are a few of the quilting junctions 26 between the top and bottom layers for controlling the "bulging" of the layers. Also, in capsules 34A and 34B there are selected quilting junctions 26 so that the wax material in the compartment will be worked properly to provide a support for the heel of a wearer. The region 38 serves to relieve pressure on the attachment of the plantar ligament.

It can be seen that the pad 10 in FIG. 1 is individually compartmented to a manner to form enclosed, fixed volume capsules that will permit a truly/rheologically plastic material, such as a wax, to conform to a surface contacting the upper layer of the pad. Because the pad material is not easily stretched, the bulging of the fixed volume of filling material is controlled by the compartment seams and by the quilting junctions or dots that join the upper and lower pad layers together in selected regions. An enlarged view of the quilting junction dots 26 adjacent a particular seam 20B is shown in FIG. 3.

Depending on the need, the 5 capsule groups may be used individually, all together, or in any other combination.

The illustrations of pads is not to scale. The pad material is much thinner than the showings in relation to the thickness of the wax layer. Thus, the drawings are illustrative, rather than to scale, for the pads shown.

Figure 4:
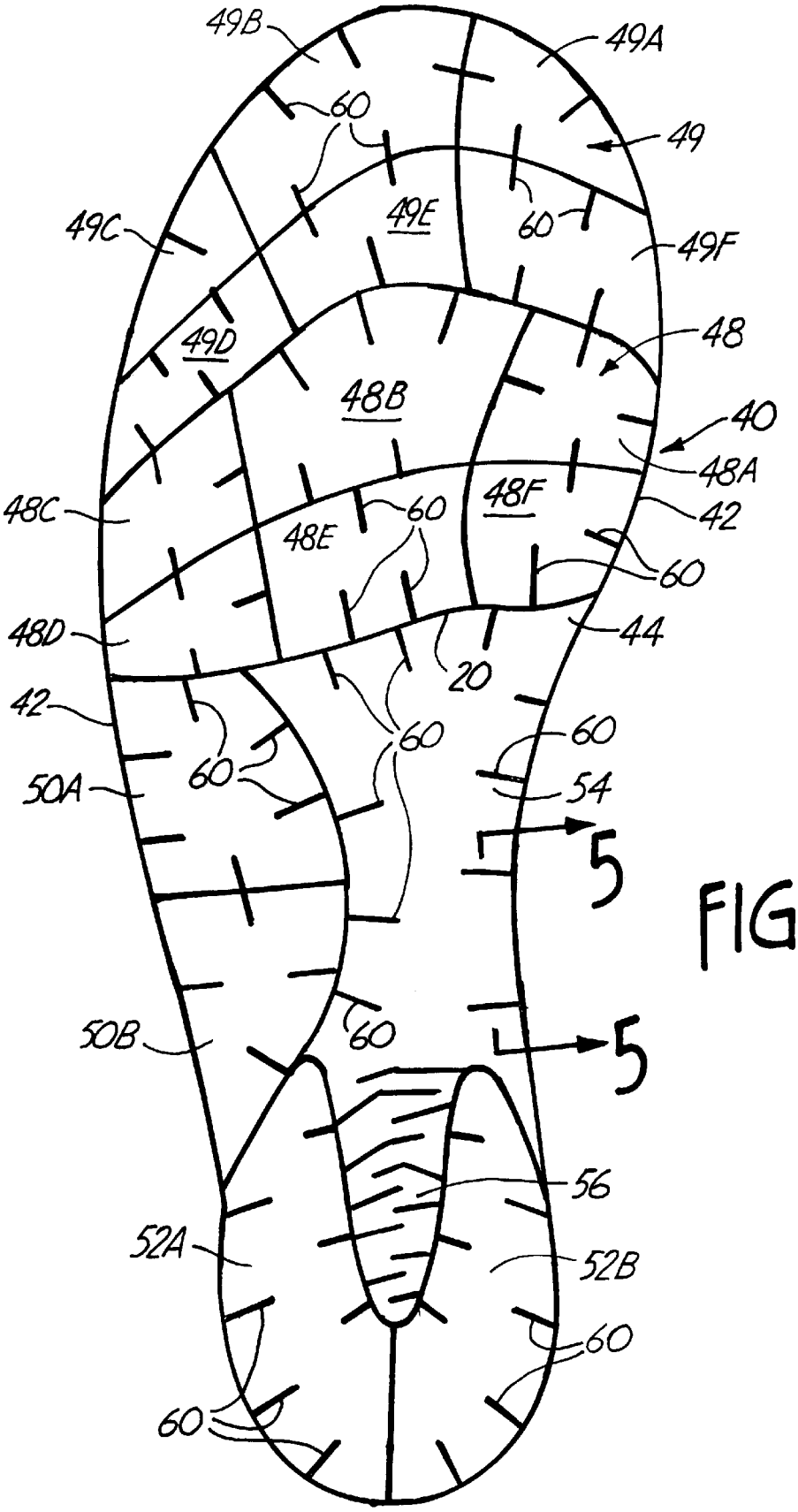
FIG. 4 is a plan view of a modified form of the present invention showing an insole with different bulge amplitude limit constraints.

FIG. 4 shows a modified form of the invention, as an insole 40, which has a peripheral seam 42 and is made up of base and overlying layers 44 and 46 in the same manner as the previous form of the invention. The interior seams dividing out compartments or capsules are the same as in FIG. 1 and numbered alike. The layers 44 and 46 are shown in FIG. 5. There is a capsule group 48 made up of six different compartments or capsules 48A–48F under the ball of the foot, as in the first form of the invention. A group 49 of capsules 49A–49F is under the toes and capsules 50A and 50B are on the lateral side of the foot. Capsules 52A and 52B are provided in the heel region. An instep or medial side capsule 54 is also provided and the plantar ligament region 56 opens to capsule 54, as in FIG. 1.

The seams for separating out the individual capsules are formed the same as in the first form of the invention by heat sealing, RF welding or, if desired, use of adhesives. The compartments or capsules are constrained in size and the fill material controlled in volume so that bulging is controlled. However, a plurality of very narrow pier seams or junction "darts" indicated at 60 are provided in the compartments, to join the base and overlying layers of the pad together along very narrow areas, that extend partially into the compartments or capsules, to control bulging in certain regions of each of the individual capsules. As the material filling the pad flows under repeated forces, the pad material conforms to the skin without pushing out all material in high load areas and bulging up in low load areas.

FIG. 5 illustrates these narrow regions 60 where the top layer is joined or fused to the bottom layer. These are much like the quilting "dots" and can be considered "quilting" in the context of the present invention.

The number of these narrow pier seams or "darts" can be selected as desired, and as shown they do not have to be in each and every compartment of the insole. These pier seams or darts can also be varied in length of extension and spacing.

The rest of the construction of the insole is the same as shown in FIGS. 1, 2 and 3, with the seams illustrated in FIG. 4 made by fusing or adhering the base and overlying layers together. If the seams are wide and the dots or piers are larger than desired, a thin layer of foam 59, as shown in FIG. 5 can be used over the upper side of the pad of the present invention. The form will tend to fill in the depressions for smoothness. The layer of foam is optional. A layer 61 (FIG. 5) of low friction surface material such as polytetrafluorethylene (PTFE) can also be used on the top of the foam or directly on top of the pad. The PTFE layer is used to reduce and control friction. By adding the PTFE only on selected regions of the pad, friction control is achieved.

Figure 6:
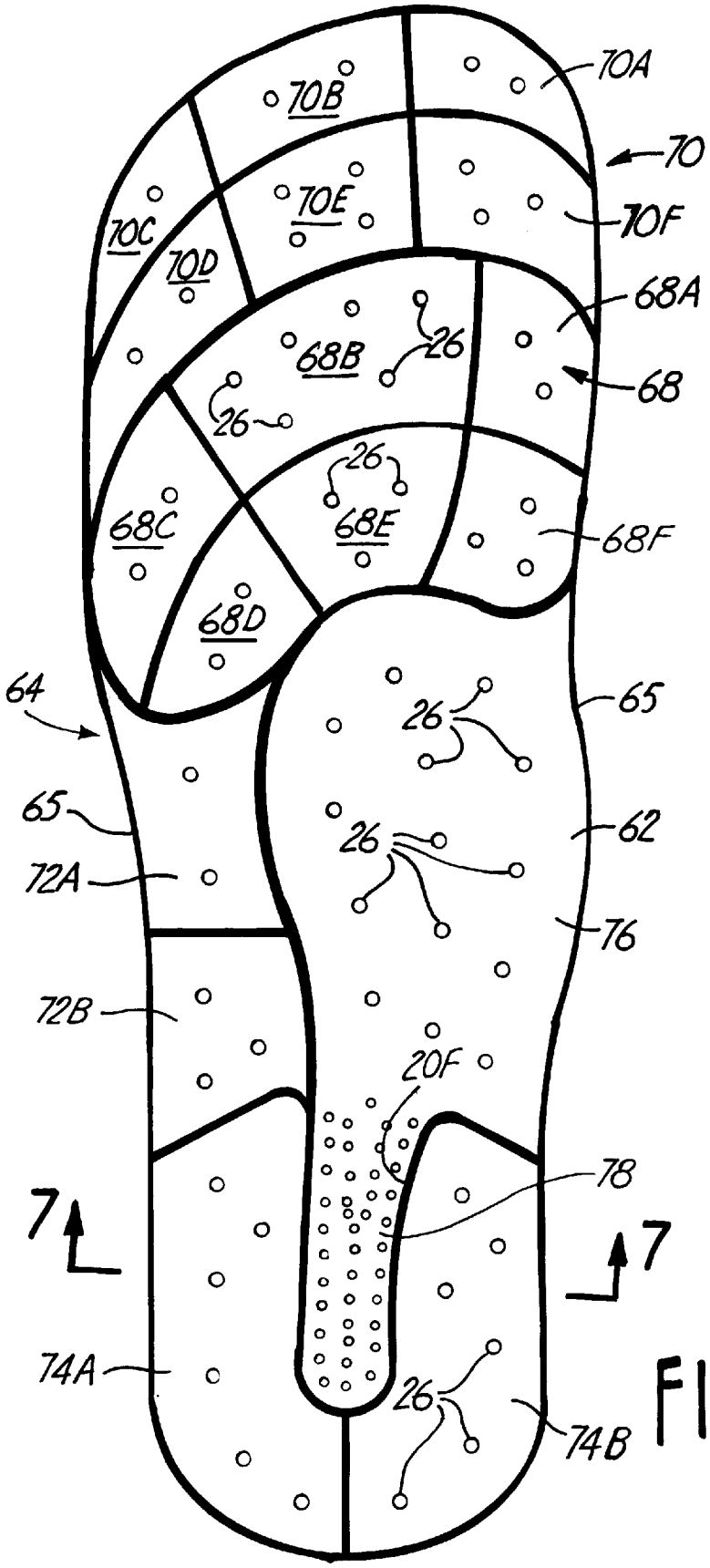
FIG. 6 is a plan view of a further modified insole showing a different configuration or shape of regions of control of bulge amplitude.

FIG. 6 shows a further modified insole 64, made of pad layers 62 and 63 fused together at a peripheral seam 65. The pad 64 has a different shape and size. A metatarsal capsule group 68 is divided up as before into individual capsules 68A–68F, and filled with the desired material between the base or bottom and overlying or top layers of the pad, which are arranged as shown in FIGS. 2 and 3. The seams, indicated generally at 67 form differently shaped peripheries of the capsules 68A–68F, and will provide different support regions.

The toe capsule group 70 is divided up into six capsules 70A–70F and have a wax material filling the capsules. The lateral side capsules 72A and 72B, the heel capsules 74A and 74B and the instep capsule 76, including region 78 are formed as before, but with slightly differently shaped peripheries. The calcaneus or heel capsules 74A and 74B form a U-shape, as was shown in FIG. 4. In this pad 64 there are a number of the quilting junctions or dots 26 provided in a fairly evenly spaced arrangement. The region 78 is provided as was shown in FIG. 4 to permit the plantar ligament to be subjected to little, if any, load.

Figure 7:
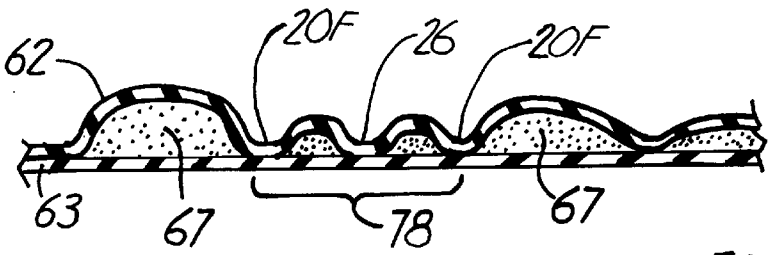
FIG. 7 is an enlarged sectional view taken as on line 7—7 in FIG. 6.

FIG. 7 illustrates a cross section to show the region 78 where relief of the plantar ligament is provided, and the two pad layers 62 and 63, respectively that are joined together. The quilting junctions 26 are also illustrated in FIG. 7 along with the peripheral or outer seam 65 of the pad.

The pad again is filled with a material indicated at 67 which is wax or other suitable material that is truly plastic, but which does not flow readily, and provides firm support after repeated applications of load.

Figure 8:
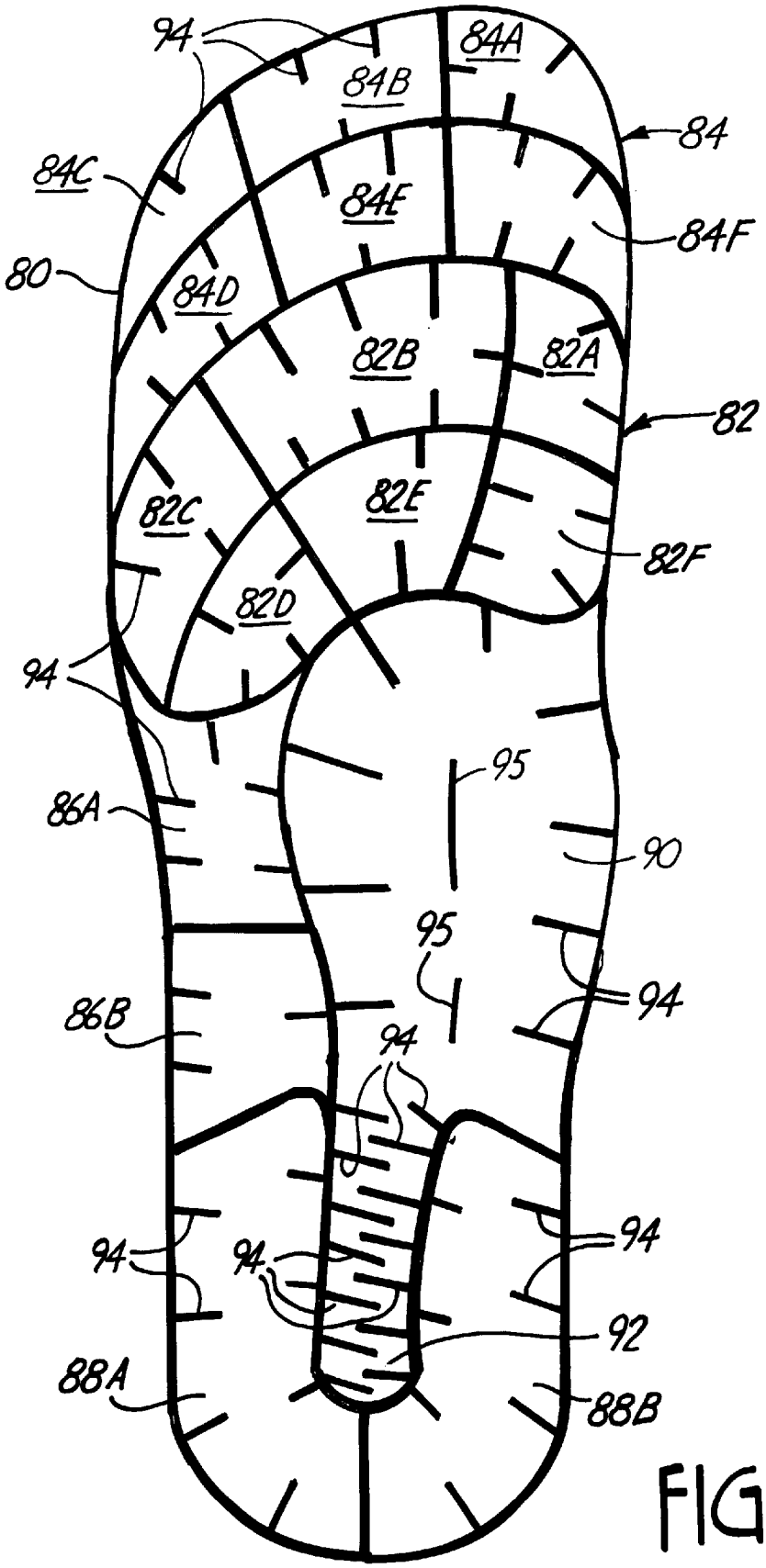
FIG. 8 is a plan view of a pad similar to FIG. 6 with different bulge amplitude limiting seams made according to the present invention.

FIG. 8 is a view of a pad similar to FIG. 6, and in this instance, the pad 82 is made in the same outer shape as that shown in FIG. 6. It includes six different compartments or capsules 82A–82F in the metatarsal capsule group 82; six capsules 84A–84F in the toe capsule group 84 in the toe area; lateral side compartments or capsules 86A and 86B, and calcaneus compartments 88A and 88B, as well as an instep compartment or capsule 90. The calcaneus compartments 88A and 88B form a U-shape again, and they define a region 92 for accommodating the plantar ligament of a user.

The seams are all shown in darkened lines, and are made as before by fusing the overlying or top and base or bottom layers together. In this form, pier seams or darts 94 are used to control filling material migration or flow. The pad or envelope layers are made of a substantially non-elastic material as explained, that can be fused or joined together along the seams, so that individual compartments or capsules can be made. The compartments are filled with a filling of material, preferably a wax as previously explained and the compartments constrain the movement of the wax so that the foot that is using the insole is supported and the pressure within each individual compartment or capsule is substantially uniform.

Figure 9:
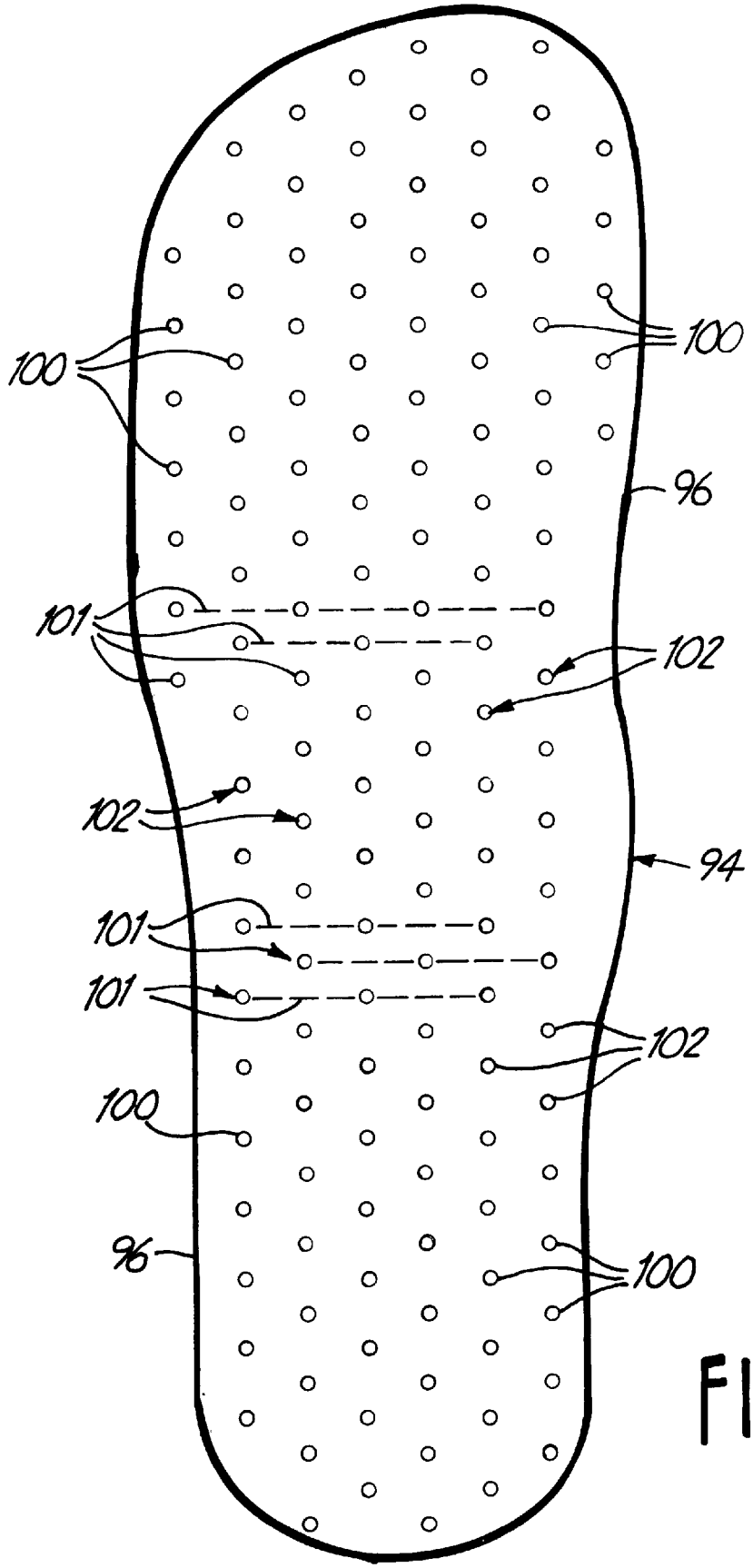
FIG. 9 is a plan view of an insole showing only "quilting" without compartments.

FIG. 9 shows a modified form of the insole shown at 94, which is made up of overlying or top and base or bottom layers of flexible material joined together with seams 96 along the sides that define the periphery. There are no interior seams to divide the compartment pad 97 into a plurality of capsules, but in this case, there are a number of quilting junctions or dots 100 provided to control bulging. The entire internal area is one capsule that is filled with wax material. The quilting junctions 100 are arranged in uniformally spaced longitudinal columns 102. The transverse rows 101 of junction are offset in adjacent columns, so the junctions 100 of one column are midway between the junctions 100 of the adjacent column.

This type of a pad shown in FIG. 9 can be used where desired. Bulging is controlled only by the junctions 100. The internal pad compartment is filled to a desired volume with wax material, as previously shown and described. The volume of the wax filling in this insole pad shifts under repeated weight application, but the top layer cannot bulge up beyond a certain thickness, because of the quilting junctions, so that there is a control of the thickness of material. This causes the filling material to maintain a layer underneath the foot.

Figure 10:
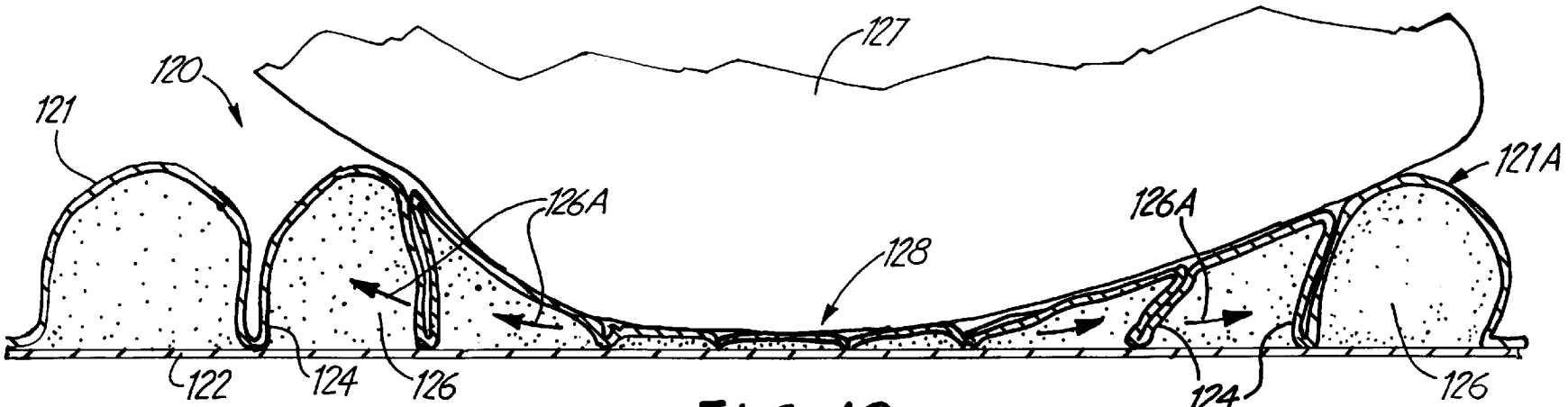
FIG. 10 is a schematic cross-sectional view illustrating a pad made according to the present invention with a substantially ideal relationship between the formation of the pad, and the volume of the wax in order to properly support bony or protuberance areas of the foot.

The placement of the seams or segregation barriers forming the individual capsules is preferred for control because as the foot proceeds from initial contact through foot flat and onto toe off during a stride does so in a sort of a rolling action. From these peristaltic type loads advancing down the length of an enclosed capsule, the contents will tend to be pumped from one end of a capsule and build-up at the other end. Such peristaltic pumping effects are minimized by installing seams transverse to the pumping direction. Those seams then form a multiplicity of segregated capsules. Particularly under the ball of the foot, in the forms of FIGS. 1–8 and as shown in FIG. 10, the peristaltic flow impeded by blocking the path of wax flow with segregating seams or barriers placed to hold the wax within capsules. Those seams also work in conjunction with the quilting features to control bulge thickness. Further, the compartments or capsules are volume limited, and then the controlling features such as quilting dots or junctions, and the pier seams fasten the top and bottom layers together. "Quilting" will control the maximum wax flow in the vertical direction by limiting the available volume to be filled. This is done without interfering with the creation of a minimal thickness under high force areas. Quilting can also be used to prevent undesired bulging in sensitive low pressure areas, and allow desirable wax fill by the presence or absence of quilting patterns into low pressure areas that are able to tolerate high or low forces.

The type of wax used can vary, but a wax such as a microcrystalline wax or a "scale wax" that forms in refineries has been found to be satisfactory. The wax should soften slightly at body temperatures, so that the flowing will occur, but it is not in any sense "liquid". The wax must have a melting point temperature which is higher than the functional temperature range of the pad.

FIGS. 10, 11, 12 and 13, are schematic cross-sectional views taken under the metatarsal area of the foot, and are provided for purposes of illustration. FIG. 10 shows a pad indicated at 120 that has an upper layer 121, and a lower layer 122 that are joined together with quilting dots shown at 124. The filling of wax shown at 126 is made to be approximately the right volume, and the quilting dots are appropriately spaced so that when the wax has completed migration after 50–200 walking gait cycles, a foot shown at 127 is supported on the pad, the bony areas of the foot just barely or almost "bottom out" in the center portions of the pad indicated at 128. It must be noted that the cross section of FIG. 10 is taken across several quilting dots 124 which are like posts, around which the wax can pass so the wax filled regions illustrated are not separate sealed capsules.

The working or movement of the foot will cause wax to flow as indicated by arrows 126A, outwardly, and the outer capsules such as that shown at 121A will restrain the flow of wax outwardly. The perimeter areas of the pad thus provide a reaction area for the flow or movement of the wax as the bony areas cause the upper layers of pad material to come very close to the lower layer of material corresponding to the apex of the bony prominence.

Figure 11:
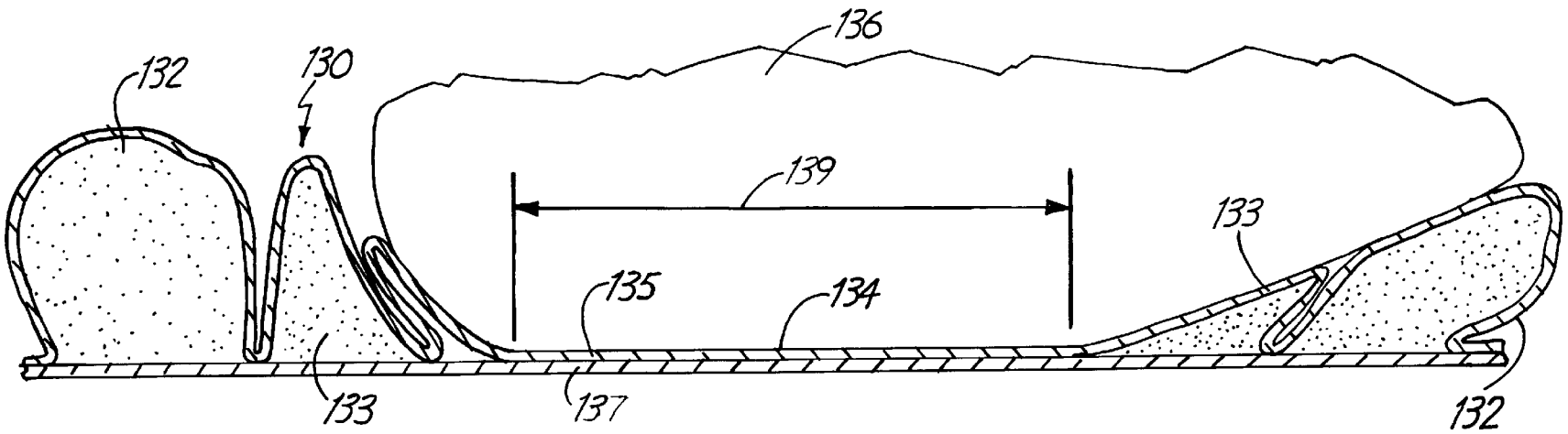
FIG. 11 is a cross-sectional illustration where the pad or envelope material is too easily stretched, that is a low tensile modulus of elasticity.

FIG. 11 is an illustration where the pad 130, which can be constructed essentially the same as that shown in FIG. 10, is made of a material that stretches too much. The modulus of elasticity is too low. The quilting dots at the outer perimeter regions indicated at 132 and 133 will not retain the wax in the center of the pad because the envelope stretches between the quilting dots. The wax in the center portions 134 will be excessively squeezed or worked outwardly and there will not be enough wax to form a well shaped cradle to support the prominence of the foot 136. The two layers of material used for forming the pad, shown at 135 and 137, will bottom out across a wide area indicated by the double arrow 139.

Figure 12:
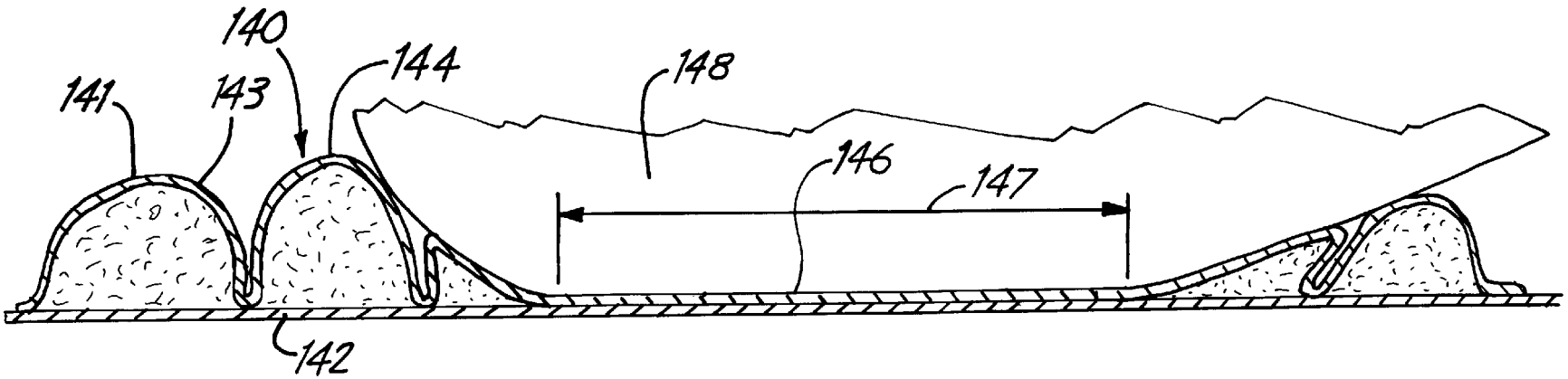
FIG. 12 is a sectional view illustrating conditions where the pad is not adequately filled with wax causing it to be formed into a cradle that is too wide and too loose to give broad close contact and support.

FIG. 12 shows a pad where there is not enough wax in the interior of the pad 140 between the top layer 141 forming the capsules, and the bottom layer 142. In this form of the invention, the perimeter areas near the outer edges of the pad such as those shown at 143 and 144 are not filled completely with the wax until a wide bottomed out region is formed. The wax from the center portions 146 will be forced out by the foot 148 to the outer sides, and a wide bottomed out region indicated by the double arrow 147 will result.

Figure 13:
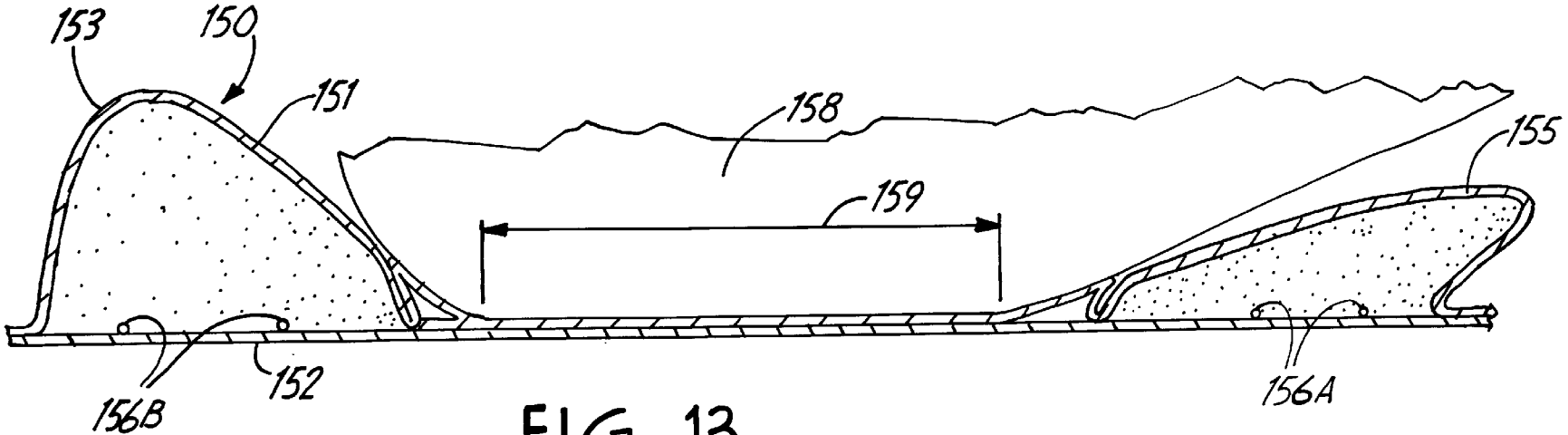
FIG. 13 is a schematic cross-sectional view wherein the cradle is too broad because the perimeter areas will accept too much volume of wax, due to insufficient quilting to limit the volume.

FIG. 13 illustrates a situation where a pad 150 is constructed with a top layer 151 and a bottom layer 152, but few or no quilting dots have been placed/welded into the perimeter regions 153 and 155. They will accept too much volume of the wax and bulge up, or out as shown at 153 and 155. If there were additional quilting dots in regions such as that shown at 156A and 156B, the outer capsules would not bulge up as much and the wax would be more properly contained to avoid bottoming out of the bony area of the foot 158 in the center regions indicated at 159. The center portion also can have additional containment regions.

These FIGS. 10–13 are for illustrative purposes, again, to show that by proper selection of the volume of the wax and having adequate "quilting" as well as adequate sets of capsules, support that is ideal such as that shown in FIG. 10 can be achieved.

Although the present invention has been described with reference to preferred embodiments, workers skilled in the art will recognize that changes may be made in form and detail without departing from the spirit and scope of the invention.

What is claimed is:

1. A pad for supporting a portion of the human body which forms an irregular surface configuration, the pad comprising two layers of substantially nonstretchable material joined together around a peripheral edge to define the pad, the layers being joined together at selected locations within an area bounded by the peripheral edge to form individual enclosed capsules within the area bounded by the peripheral edge, and a filling of a non-resilient, rheologically plastic conformable wax material only in the pad which will move slowly under repeated applications of force to assume configurations of a surface contacting and loading one of the layers of the pad and which retains the configurations when force is no longer applied, the selected locations being selected to restrain bulging of the material in the pad by separating the layers of material in regions that are lightly loaded, and the seams of the capsules preventing the wax material from moving from the capsule.

2. The pad of claim 1, wherein said wax material remains plastic at temperatures ranging between 70 F to 110 F.

3. The pad of claim 1, wherein the pad comprises a foot pad and a plurality of transversely extending seams joining the layers of material together in toe and metatarsal regions of the pad, and at least one fore and aft extending seam between the transversely extending seams in the toe and metatarsal support region to form a plurality of enclosed capsules in both the toe and metatarsal regions to resist peristaltic pumping action on the filling material of the pad.

4. The pad of claim 3 and a plurality of quilting junction regions between the layers, wherein the layers forming the pad are joined together at small area junctions.

5. The pad of claim 1, wherein the selected locations include seam lines that join the layers of material to form at least one capsule separated from other portions of the area bounded by the peripheral edge.

6. The pad of claim 5 and a plurality of quilting junctions between the layers of material within the at least one capsule.

7. The pad of claim 5 and a plurality of short seams joining the layers of material and extending inwardly from the seam line toward center portions of the at least one capsule.

8. The pad of claim 1, wherein the two layers of material forming the pad are substantially non-stretchable material and wherein the pad comprises an insole pad, and a plurality of seams between the layers of material to divide the pad into a plurality of enclosed capsules including three transversely extending seams in a metatarsal support region of the insole pad to isolate the metatarsal region from other portions of the insole pad, a plurality of longitudinal seams between the transverse seams to form a plurality of enclosed capsules in the metatarsal region, the enclosed capsules holding a predetermined volume of the wax material in the enclosed capsules in the metatarsal region to provide separate support for the metatarsal portions of a foot supported on the pad.

9. An insole pad for supporting a foot comprising two layers of material joined together around a peripheral edge to define the pad, the layers being joined together at selected locations within an area bounded by the peripheral edge, including a first region adapted to underlie the metatarsal phalangeal joint of a foot, and wherein there are continuous interior seam lines joining the layers of material forming enclosed individual, fixed volume capsules within an area bounded by the peripheral edge, the seam lines including two transverse seam lines to isolate the first region from other portions of the insole and form one of the capsules, said capsules all having a fixed volume filling in each fixed volume capsule comprising a wax having a melting temperature substantially between 150 F to 160 F, and the two transverse seam lines preventing the wax from moving portions of insoles other than the region, the wax having a consistency such that it will move slowly under repeated applications of force to assume configurations of a surface contacting and loading one of the layers of the pad and which retains the configurations when force is no longer applied, the selected locations being selected to restrain bulging of the material in the pad by separating the layers of material in regions that are lightly loaded and each of the capsules adapted to underly the metatarsal phalangeal joint including a plurality of junction darts joining the two layers to control bulging as the wax moves to retain the configurations formed by repeated applications of load.

10. The pad of claim 9, wherein the fixed volume of wax material in the enclosed capsules is sufficient a volume to provide separation of the two layers of material forming the insole in all capsules in insole.

11. The pad of claim 9, wherein there are three transverse seam lines in the first region of the pad, the transverse seam lines having a center seam line, a forward seam line, and a rear seam line, and a plurality of longitudinally extending seam lines between the forward seam line and the center seam line, and a second plurality of longitudinally extending seam lines between the center seam line and the rearward seam line to form individual capsules, each filled with a controlled volume of the rheologically plastic material.

12. An insole pad for supporting a foot of the human body comprising base and overlying layers of flexible substantially non-stretchable material joined together around a peripheral edge to define the insole pad, the insole pad comprising an enclosed compartment surrounded by the peripheral edge with a length and a width, a plurality of junction regions holding the base and overlying layers together within the area bounded by the peripheral edge to control the amount that the base and overlying layers can separate at any location when a load is applied to the pad, the junction regions defining a pair of spaced, transverse sealing lines extending across the entire width of the pad to separate a separate capsule in the metatarsal region, and one of the transverse sealing lines forming a separate capsule in a toe region of the pad, and a filling of a moldable plastic in each capsule and other portions of the compartment material that is sufficiently plastic to mold to conform to a foot surface under repeated loads in response to pressures from the foot surface on a layer of the pad.

13. The pad of claim 12, wherein said paid has a plurality of transverse seams joining the base and overlying layers, and a plurality of fore and aft extending seams between the transverse seams to form individual capsules of selected size in selected regions of the pad.

14. The pad of claim 13, wherein one of the selected regions comprises a heel region of the insole pad, said seams defining a U-shaped support area around the peripheral edge in the heel region of the pad, and a portion of the pad in a center of the heel region separated from the capsules adjacent the peripheral edge of the heel region, such that the capsules adjacent the peripheral edge are filled with a wax material to support a heel along the peripheral edges thereof.

15. The pad of claim 14 and a layer of foam overlying the pad.

16. The pad of claim 12 and low friction surface material forming at least portions of the upper surface of the pad.

17. A method of custom fitting an insole comprising the steps of providing an insole pad having upper and lower layers joined around a peripheral edge defining an insole pad edge, and a plurality of enclosed separate insole capsules within the confines of the insole pad edge, filling the insole pad capsules to a desired volume of a wax material that will flow and migrate to conform to a foot surface under repeated loads on the pad occurring in 50 to 200 gait cycles of a wearer, wearing the pad between 50 to 200 gait cycles to cause the wax to move to conform to the bottom surface of a foot that is supported by the insole until migration ceases and the wax conforms to the bottom surface of a foot.

18. The method of claim 17 further comprising providing junctions between the upper and lower layer or material to control separation of the layers of the insole pad within the capsules formed.

* * * * *

UNITED STATES PATENT AND TRADEMARK OFFICE

CERTIFICATE OF CORRECTION

PATENT NO. : 6,412,194 B1
DATED : July 2, 2002
INVENTOR(S) : J. Martin Carlson

It is certified that error appears in the above-identified patent and that said Letters Patent is hereby corrected as shown below:

Column 12,
Line 57, cancel "layer or" and insert -- layers of --.

Signed and Sealed this

Eleventh Day of February, 2003

JAMES E. ROGAN
*Director of the United States Patent and Trademark Office*